US006509876B1

(12) United States Patent
Jones et al.

(10) Patent No.: US 6,509,876 B1
(45) Date of Patent: Jan. 21, 2003

(54) ANTENNA FOR WIRELESS COMMUNICATION SYSTEM

(75) Inventors: Jeffrey L. Jones, Orem, UT (US); Kurt Stewart, Lehi, UT (US); Rick D. Giles, Sandy, UT (US); Robert Merrill, Bountiful, UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/657,500

(22) Filed: Sep. 8, 2000

(51) Int. Cl.[7] ..... H01Q 1/24

(52) U.S. Cl. ..... 343/702; 343/700 MS; 455/90; 361/737

(58) Field of Search ..... 343/700 MS, 702; 361/737, 736, 752, 753; 455/90

(56) References Cited

U.S. PATENT DOCUMENTS

| | | | |
|---|---|---|---|
| 1,780,847 | A | 11/1930 | Smith |
| 2,445,244 | A | 7/1948 | Seaver |
| 2,518,812 | A | 8/1950 | Oswald |
| 2,916,720 | A | 12/1959 | Steans |
| 3,014,160 | A | 12/1961 | Brogden |
| 3,289,149 | A | 11/1966 | Pawloski |
| 3,368,181 | A | 2/1968 | Gimpel |
| 3,433,886 | A | 3/1969 | Myers |
| 3,757,102 | A | 9/1973 | Roberts |
| 3,771,098 | A | 11/1973 | Dempsey |
| 3,794,956 | A | 2/1974 | Dubreuil |
| 4,059,321 | A | 11/1977 | Rasmussen et al. |
| 4,186,988 | A | 2/1980 | Kobler |
| 4,241,974 | A | 12/1980 | Hardesty |
| 4,303,296 | A | 12/1981 | Spaulding |
| 4,352,492 | A | 10/1982 | Smith |
| 4,407,559 | A | 10/1983 | Meyer |
| 4,428,636 | A | 1/1984 | Kam et al. |
| 4,511,198 | A | 4/1985 | Mitchell et al. |
| 4,710,136 | A | 12/1987 | Suzuki |
| 4,778,410 | A | 10/1988 | Tanaka |
| 4,809,360 | A | 2/1989 | Kraft |

(List continued on next page.)

FOREIGN PATENT DOCUMENTS

| | | |
|---|---|---|
| CH | 682961 | 12/1993 |
| DE | 0 355 413 | 7/1989 |
| JP | 54-38587 | 3/1979 |
| JP | 58-34370 | 5/1983 |
| JP | 61-256850 | 11/1986 |
| WO | WO 95/13633 | 6/1995 |

OTHER PUBLICATIONS

Perkins, N. K. "Switching Connector," IBM Technical Disclosure Bulletin, vol. 7, No. 6, Nov. 1964.

(List continued on next page.)

*Primary Examiner*—Don Wong
*Assistant Examiner*—Shih-Chao Chen
(74) *Attorney, Agent, or Firm*—Workman, Nydegger & Seeley

(57) ABSTRACT

An antenna system for a communication card provides wireless or radio frequency (RF) communication with other networks or communication systems. The antenna system includes an antenna attached to a retractable platform that is selectably movable between an extended position and a retracted position. When wireless communication is desired, the retractable platform is located in the extended position and the antenna is substantially disposed outside of the body of the communications card. When wireless communication is not desired, the retractable platform and antenna are stored inside the body of the communications card in the retracted position. Desirably wireless communication is automatically available when the retractable platform is in the extended position, and wireless communication is automatically unavailable when the retractable platform is in the retracted position.

12 Claims, 12 Drawing Sheets

U.S. PATENT DOCUMENTS

| | | | | |
|---|---|---|---|---|
| 4,915,648 | A | | 4/1990 | Takase et al. |
| 5,035,641 | A | | 7/1991 | Van-Santbrink |
| 5,051,099 | A | | 9/1991 | Pickles et al. |
| 5,132,877 | A | | 7/1992 | Branan et al. |
| 5,139,439 | A | | 8/1992 | Shie |
| 5,183,404 | A | | 2/1993 | Aldous et al. |
| 5,184,282 | A | | 2/1993 | Kaneda et al. |
| 5,336,099 | A | | 8/1994 | Aldous et al. |
| 5,338,210 | A | | 8/1994 | Beckham et al. |
| 5,391,094 | A | | 2/1995 | Kakinoki et al. |
| 5,411,405 | A | | 5/1995 | McDaniels et al. |
| 5,481,616 | A | | 1/1996 | Freadman |
| 5,499,923 | A | | 3/1996 | Archibald et al. |
| 5,505,633 | A | | 4/1996 | Broadbent |
| 5,509,811 | A | | 4/1996 | Homic |
| 5,538,442 | A | | 7/1996 | Okada |
| 5,547,401 | A | | 8/1996 | Aldous et al. |
| 5,561,727 | A | | 10/1996 | Akita et al. |
| 5,562,504 | A | | 10/1996 | Moshayedi |
| 5,608,607 | A | | 3/1997 | Dittmer |
| 5,634,802 | A | | 6/1997 | Kerklaan |
| 5,660,568 | A | | 8/1997 | Moshayedi |
| 5,667,390 | A | | 9/1997 | Keng |
| 5,667,395 | A | | 9/1997 | Okada et al. |
| 5,679,013 | A | | 10/1997 | Matsunaga et al. |
| 5,727,972 | A | | 3/1998 | Aldous et al. |
| 5,773,332 | A | | 6/1998 | Glad |
| 5,797,771 | A | | 8/1998 | Garside |
| 5,816,832 | A | | 10/1998 | Aldous et al. |
| 5,918,163 | A | * | 6/1999 | Rossi ..... 455/90 |
| 6,172,645 | B1 | * | 1/2001 | Hollander et al. ..... 343/702 |
| 6,295,207 | B1 | * | 9/2001 | Jones ..... 361/737 |

OTHER PUBLICATIONS

"Multi–Port Connector Adapter and Cabling for Personal Computers," IBM Technical Disclosure Bulletin, vol. 32, No. 10B, Mar. 1990.

Knight et al. "Electrical Connector for Flat Flexible Cable," IBM Technical Disclosure Bulletin, vol. 25, No. 1, p. 370, Jun. 1982.

* cited by examiner

ANTENNA FOR WIRELESS COMMUNICATION SYSTEM

BACKGROUND OF THE INVENTION

1. Field of the Invention

The present invention generally relates to a wireless communication system and, in particular, to a retractable antenna for an electronic communication card that allows wireless communication.

2. Description of Related Art

Computers are often connected to various communication systems to communicate, exchange data, and transmit various types of information. In particular, computers are often linked by communication systems or networks such as Local Area Networks (LANs), Wide Area Networks (WANs), Internet, Ethernet and conventional telephone networks. These communication systems typically require the computers to be physically attached by wires such as telephone lines or other specialized wiring. In some locations, however, it is difficult if not impossible to be physically connected to a communication system. Additionally, these communication systems generally cannot be used if the user is traveling or moving between locations.

Conventional computers often use electronic communication cards to connect to these communication systems or networks. The communication cards are often in the form of modular cards that can be plugged into a slot or receiving port in the computer. These communication cards can be easily inserted and removed for use with different computers and the cards allow communication with different networks or systems to be established. These communication cards are often constructed according to the Personal Computer Memory Card International Association (PCMCIA) guidelines or standards for purposes of compatibility and wide use. Communication cards that conform to these standards are often referred to as PCMCIA or PC cards.

It is also known to use cellular telephones and other wireless systems to connect computers to various communication systems and networks. Cellular telephone systems are particularly effective in allowing computers to communicate because the computers do not have to be physically connected to telephone lines or other specialized wiring. In contrast, the computers are connected to the communication system by the cellular telephone network. Additionally, cellular telephone systems are very useful in connection with portable computers because the cellular communication circuitry can be miniaturized and provided as a component of the computer.

These known cellular telephone systems and other types of wireless communication networks require the use of antennas. Conventional antennas are typically placed external to the body of the computer because of noise, interference, obstruction and shielding caused by the various components of the computer. Conventional antennas generally do not function correctly if they are obstructed or shielded by the housing or other structures of the computer.

Conventional antennas are generally rigid and protrude a relatively long distance from the body of the computer. These protruding antennas are often large, unwieldy, aesthetically unpleasing and they make the computer difficult to move and transport. In addition, these antennas are often bent, broken, knocked out of alignment or otherwise damaged because they can easily catch or strike objects such as people, walls, doors, etc. Further, these known antennas require a large support structure to secure the antenna to the housing of the computer and this support structure requires a considerable amount of space inside the body of the computer. This space is very valuable, especially in small, portable computers. Additionally, the support structure is often damaged when the antenna is accidentally moved.

The repair and replacement of conventional antennas and the associated support structure is often difficult and costly. In fact, the entire antenna assembly is often removed and replaced instead of attempting to repair a portion of the antenna or support structure. Thus, the repair and replacement of the antenna and/or antenna support structure is expensive and time consuming.

In order to alleviate these problems, conventional antennas are often removed or detached from the computer before it is moved or transported. Additionally, conventional antennas must often be removed before the computer can be inserted into its carrying case. Disadvantageously, this requires additional time and resources to remove and reattach the antenna each time the computer is moved. Additionally, when the antenna is detached from the computer, it is often misplaced, lost or damaged. Further, because the user often does not want to take the time and effort to remove the antenna, the computer is moved with the antenna still attached to the computer and this frequently results in the antenna being damaged or broken.

It is known to use a telescoping antenna in an attempt to minimize these problems. For example, U.S. Pat. No. 5,684,672 issued to Karidis, et al. discloses a laptop computer with an integrated multi-mode antenna. The telescoping antenna is integrated into the cover or display portion of the laptop computer and it outwardly extends from the display portion for use. The telescoping antenna is then retracted into the display portion when it is not in use. A coaxial cable connects the antenna to the base of the computer. In particular, the coaxial cable connects the antenna to a radio frequency (RF) adaptor card inserted into a PCMCIA slot located in the base of the computer. Disadvantageously, the telescoping antenna disclosed in the Karidis patent is large, extends a great distance from the body of the computer, and requires the user to manually extend and retract the antenna.

It is also known to attach an antenna to a drawer that can be extended and retracted from the housing of a computer. U.S. Pat. No. 5,557,288 issued to Kato, et al., discloses a drawer that passes through an opening in the housing of the computer when it is moved between the extended and retracted positions. When wireless communication is desired, the user must open a door to the opening in the housing, extend the drawer through the opening, and rotate and extend the antenna into the desired position. When the wireless communication is finished, the user must rotate and withdraw the antenna into a storage position, retract the drawer into the computer, and close the door to the opening. Disadvantageously, the system disclosed in the Kato patent requires numerous steps by the user before wireless communication can be established, and numerous steps to retract and store the antenna. Further, the device disclosed in the Kato patent requires a large amount of space, which is very valuable in portable or compact computers.

A disadvantage of these known systems is the antenna is always operable and ready for wireless communication. Thus, inadvertent wireless communication may occur, or wireless communication may occur when it is prohibited. Additionally, the antenna may transmit or receive wireless signals while it is stored inside the computer, which may cause interference and disrupt the operation of the computer.

Another disadvantage is the antenna system is continually drawing power from the computer. This is especially a problem with portable or smaller-sized computers that have a need for a long-lasting and portable power supply. Because portable computers are often used in environments where access to conventional power supplies are not available, a battery or similar power supply is needed. The electrical storage capability of the battery, however, is generally in direct proportion to its physical size. Thus, in instances where a smaller battery is used, there is a need to conserve the electrical power used by the computer, and any connected peripherals, to lengthen the usable life of the battery.

SUMMARY OF THE INVENTION

A need therefore exists for an antenna system for a communication card that eliminates the above-described disadvantages and problems.

One aspect of the present invention is an antenna system for a communication card. The antenna system advantageously provides wireless or radio frequency (RF) communication with other networks or communication systems to allow data and other information to be shared or exchanged. The antenna system includes an antenna attached to a retractable platform that is selectably movable between an extended position and a retracted position. When wireless communication is desired, the retractable platform is located in the extended or use position and the antenna is substantially disposed outside of the body of the communications card. When wireless communication is not desired, the retractable platform and antenna are stored inside the body of the communications card in the retracted or stored position. This stored position protects the retractable platform and antenna from damage. Advantageously, the antenna can be quickly and easily positioned in the extended position for use, and it can be simply and promptly placed in the stored position when wireless communication is not desired.

Another aspect is an antenna system in which wireless communication is unavailable or inoperative when the retractable platform is in the storage position. Wireless communication, however, is available and operable when the retractable platform is in the extended position. Preferably, the antenna system is automatically operable and ready for use in the extended position, and is automatically inoperable in the storage position. That is, the antenna system is automatically turned on or enabled in the extended position, and turned off or not enabled in the storage position. Desirably, this process occurs without any intervention by the user other than to extend or retract the retractable platform.

Yet another aspect of the antenna system is a control mechanism, such as a switch, that controls whether wireless communication is available or operable. In particular, the control mechanism is used to prohibit operation of the antenna system during selected periods. Desirably, the control mechanism controls the ability of the antenna system to operate based upon the positioning of the retractable platform and by controlling the supply of electrical power to the antenna system.

The antenna system advantageously saves power and/or battery life by being turned off in the storage position. Additionally, by preventing use of the antenna or wireless system in the storage position, this may comply with future Federal Aviation Administration (FAA) or Federal Communication Commission (FCC) requirements that wireless communication not be permitted in certain locations or during specific times. For example, wireless communication may not be permitted on airplanes, in hospitals, at construction sites, within high security buildings, or at other sensitive or protected areas. Thus, by simply storing the retractable platform in the storage position, wireless communication is not permitted. The other features of the communication card and/or computer, however, may still be usable even though wireless communication is not possible. Thus, the user may continue to use the communication card and/or computer, even though wireless communication is not permitted.

Significantly, by storing the retractable platform in the retracted position, that physically and clearly indicates that wireless communication is not possible. Thus, a pilot or flight attendant, for example, could quickly and easily ensure that wireless communication is not possible, even though the computer or electronic device is still operable. Desirably, a visual indicator or other signal may also be used to confirm that the wireless communication feature is disabled.

Still another aspect of the antenna system is a mechanism for retracting the antenna into the storage position when wireless communication is not desired and deploying the antenna when wireless communication is desired. Desirably, the mechanism used to extend and retract the antenna is a retractable platform that is movable between an extended portion and a retracted position. The antenna is desirably attached to the outer portion of the retractable platform such that it is located a sufficient distance from the body of the computer in the extended position. This optimizes the reception of the antenna because the computer or communication card can block, shield or interfere with the wireless signal. Additionally, because wireless communication is not available when the retractable platform is in the storage position, the antenna is not transmitting signals or causing RF interference within the electronic device. This may help improve the performance of the electronic device.

Yet another aspect is an antenna system that is an integral part of a communication card. In particular, the communication card includes a retractable platform and at least an antenna is mounted to the platform. The circuitry or other components necessary for wireless communication are located in the communication card and/or the retractable platform. Advantageously, if the antenna system is an integral part of the communication card, the card can be quickly and easily connected to various suitable electronic devices, and the card can be used interchangeably with other devices. This increases the flexibility and potential uses of the antenna system and communication card. The antenna or antenna system can also be removably attached to the communication card or other suitable electronic device to allow different antennas to be attached and facilitate repair.

Another aspect is an antenna system that can be optimized for use with a particular wireless system. For example, the antenna can be configured to receive or transmit specifically on the frequencies of the desired wireless communication system.

Another aspect of the antenna system is an indicator that is attached to the retractable platform or communication card. The indicator is preferably a light source that indicates use of the antenna system or that wireless communication is available. The indicator can also indicate that the antenna system or wireless communication is not available or inoperable. The indicator may also be used to indicate other information such as power, status, diagnostics, etc.

Advantageously, because the antenna and its associated components are very small and compact, it has minimum size and space requirements. Accordingly, the antenna system can be easily attached to the retractable platform and/or communication card, and it requires only a small space. This significantly decreases design and manufacturing costs.

A preferred embodiment is an apparatus that controls the operational state of the antenna system based upon the positioning of the retractable platform. The antenna is attached to the retractable platform and the platform is selectively movable between an extended position and a retracted position. Wireless communication is enabled when the retractable platform is in the extended position, but wireless communication is not available in the retracted position. Desirably, a control mechanism is used to determine if wireless communication is available. For example, the control mechanism may only provide electrical power to the antenna system in the extended position and not the retracted position. The control mechanism, for example, may include a switch, optical sensor, or electrical contacts to control whether wireless communication is possible. Advantageously, because the antenna system may be selectively powered, this can greatly reduce the amount of electrical power used by the host device, which thereby increase its useful battery life. Significantly, while the antenna system cannot be used to transmit or receive wireless signals when the platform is retracted, the computer and/or communication card may still be used.

Another preferred embodiment is an antenna system mounted to a retractable platform that is moveable between an extended position and a retracted position. Extension of the retractable platform causes a control mechanism to indicate that the antenna system is "ready for use." This status will be supplied to an appropriate control circuit. For instance, the control circuit can supply electrical power to the antenna system to enable wireless communication. When the connector is retracted, the control mechanism indicates that the antenna system is "inoperative or not usable." Accordingly, the control circuit could, for example, cut off or limit the electrical power that is supplied to the antenna system such that the antenna system could not be used for wireless communication.

These and other aspects, features and advantages of the present invention will become more fully apparent from the following detailed description and appended claims, or may be learned by the practice of the invention as set forth hereinafter.

BRIEF DESCRIPTION OF THE DRAWINGS

The appended drawings contain figures of preferred embodiments of the present antenna system for a portable computer. The above-mentioned aspects, features and advantages of the antenna system, as well as other features, will be described in connection with the preferred embodiments. Understanding that these preferred embodiments are only intended to illustrate the invention and not limit its scope, the invention will be described and explained with additional specificity and detail through the use of the accompanying drawings in which.

DETAILED DESCRIPTION OF THE PREFERRED EMBODIMENTS

The present invention involves an antenna system for use with an electronic device such as a communication card. The communication card is preferably used in connection with a computer, such as a portable or laptop computer, but it will be understood that the computer may be any suitable type of general or special purpose computer. The principles of the present invention, however, are not limited to communications cards or computers. It will be understood that, in light of the present disclosure, the antenna system disclosed herein can be successfully used in connection with other types of electronic devices.

Additionally, to assist in the description of the antenna system, words such as top, bottom, front, rear, right, left, vertical and horizontal are used to describe the accompanying figures. It will be appreciated, however, that the antenna system can be located in a variety of desired positions—including various angles, sideways and even upside down. A detailed description of the antenna system now follows.

Figure 1:
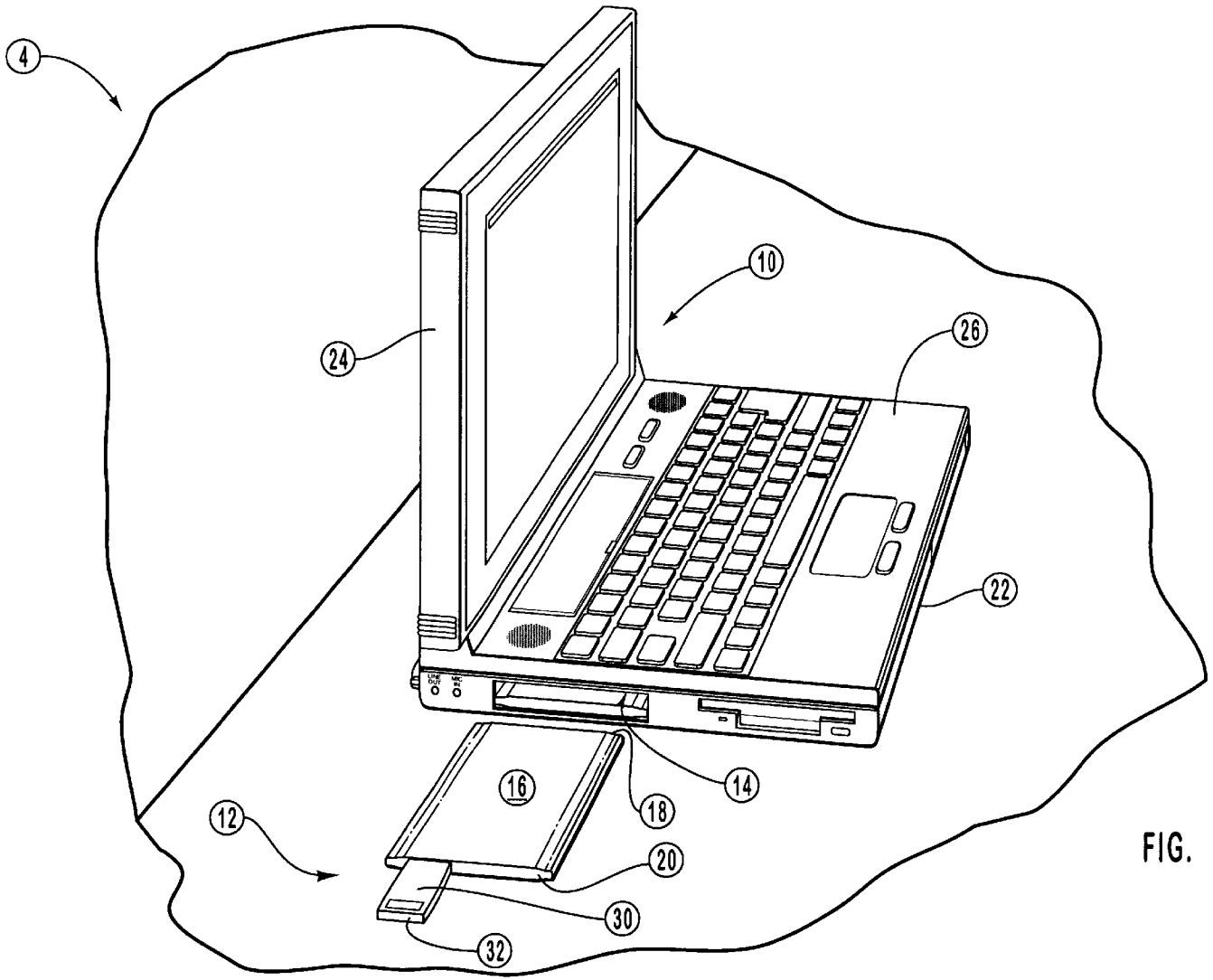
FIG. 1 is a perspective view of a portable computer and a communication card, illustrating a preferred embodiment of the retractable platform and antenna system.

FIG. 1 illustrates a portable computer 10 with an antenna system 12 in accordance with a preferred embodiment of the present invention. The term portable computer 10 is used broadly to describe any suitable computer such as a personal computer, laptop computer, notebook computer, hand-held computer, palm computer or other type of computer with suitable characteristics. The antenna system 12 can also be used with other electronic devices such as cellular telephones, digital communication systems, personal data assistants (PDAs), electronic organizers, GPS systems, wireless communication systems, and the like. The antenna system 12 can also be used with other devices that may benefit from the ability to communicate over wireless networks such as television sets, digital telephones, automotive electronics, etc.

The portable computer 10 includes one or more slots 14 (two exemplary slots are shown in FIG. 1) for detachably receiving a communication card 16. The communication card 16 includes a first end 18 that is inserted into the slot 14 and a second end 20 that is located generally parallel to an outer surface of the computer 10 when the card is inserted into the slot. Disposed along the first end 18 of the card 10 is an edge connector (not shown) that is designed to electrically communicate with a corresponding socket located in the slot 14. The slot 14 and communication card 16 preferably comply with applicable Personal Computer Memory Card International Association (PCMCIA) standards. The PCMCIA standards, for example, are described in detail in the PCMCIA Specification Standards, which are hereby incorporated by reference. The PCMCIA Specification Standards provide standards for data storage, peripheral expansion cards, input/output (I/O) capability for a standard bus extension slot so that peripherals such as modems and LAN adapters can use the bus and other related information. It will be understood, however, that while the communication card 16 is described with respect to PCMCIA standards, the antenna system 12 may be used with virtually any type of communication card or electrical device. Additionally, while the communication card 16 is preferably a miniature type, any suitable size and type of card may be used.

As illustrated in FIG. 1, the computer 10 includes a body or housing 22 that includes a cover or upper portion 24 and a base or lower portion 26. Located within the base 26 are various known computer circuitry components such as processing units, printed circuit boards and memory storage devices. One skilled in the art will understand that the computer 10 may include various components depending, for example, upon the type and configuration of the computer. The computer 10 also includes circuitry and components that allow electrical communication to be established with a communication card 16 inserted into the slot 14. The communication card 16 may also include circuitry and components that allow electrical communication with the computer 10.

The communication card 16 includes a retractable platform 30 with one or more antennas 32, and disposed within the communication card is circuitry that provides an interface between the card and the antenna. The circuitry contained within the communication card 16 may include, for example, a printed circuit board and may provide processing such as RF signal processing and/or baseband processing. The communication card 16 and/or computer 10 may also include a power source such as a battery or other device to provide power to the antenna system 12, but it will be understood that the antenna system may receive power from any suitable source.

In greater detail, the antenna system 12 includes the antenna 32 and some, if not all, of the circuitry and components required for wireless communication. For example, the antenna system 12 may include impedance matching circuitry, ground plane, etc., and some or all of this circuitry and/or components may be disposed on the retractable platform 30 or within the communication card 16. Additionally, the antenna 32 may include any suitable number or types of radiating elements, and the antenna and antenna system 12 are preferably optimized for specific use at a given frequency. In particular, the antenna 32 may be dimensioned and the components of the antenna system 12 may be constructed to optimize RF reception and transmission at frequencies within the frequency bands of the wireless system. One skilled in the art will appreciate that the antenna 32 and antenna system 12 may be optimized for use with a wide variety of electronic devices.

The antenna 32 and antenna system 12 are configured to allow communication with a wireless communications network. The wireless communications network, for example, may include wireless modems, wireless LAN, wireless Personal Area Network (PAN), cellular telephone networks, digital communication systems, etc. The wireless communication network may also include low-powered or short-range radio systems, such as Bluetooth systems that allow products containing Bluetooth technology to be interconnected via wireless communication.

As shown in FIG. 1, the antenna 32 is preferably a chip or strip type antenna, but any suitable type of antenna may be used depending upon factors such as desired polarization and radiation patterns, or type of wireless communication system. Additionally, the antenna 32 and antenna system 12 are preferably configured for optimized use with a particular wireless communication system. For example, antenna 32 and the antenna system 12 may be configured to conform to applicable Bluetooth technology specifications and standards, which allows the computer 10 to be connected to a wide range of computing and telecommunication devices via wireless connections. Thus, the antenna 32 would be configured to use the Industrial Scientific and Medical (ISM) frequency band of 2.4 to 2.4835 gigahertz (GHz). Specifications and other information regarding Bluetooth technology are available at the Bluetooth Internet site www.bluetooth.com and are published in the Bluetooth Special Interest Group (SIG), which are hereby incorporated by reference. One skilled in the art will appreciate that the antenna 32 and antenna system 12 can be used with any suitable wireless communication system.

As shown in the accompanying Figures, the retractable platform 30 is movable between an extended position and a retracted position 36. The retractable platform 30 is preferably similar to the retractable devices described and illustrated in U.S. Pat. Nos. 5,183,404; 5,338,210; 5,547,401; 5,727,972; and pending U.S. patent application Ser. No. 09/357,017, each of which are hereby incorporated by reference. In addition, retractable devices described and illustrated in U.S. Pat. No. 5,562,504 or co-pending United States application Ser. No. 09/271,620, which are also hereby incorporated by reference, could be utilized. It will be appreciated, however, that any retractor platform with suitable characteristics could be used in conjunction with the antenna 32 or antenna system 12.

Figure 2:
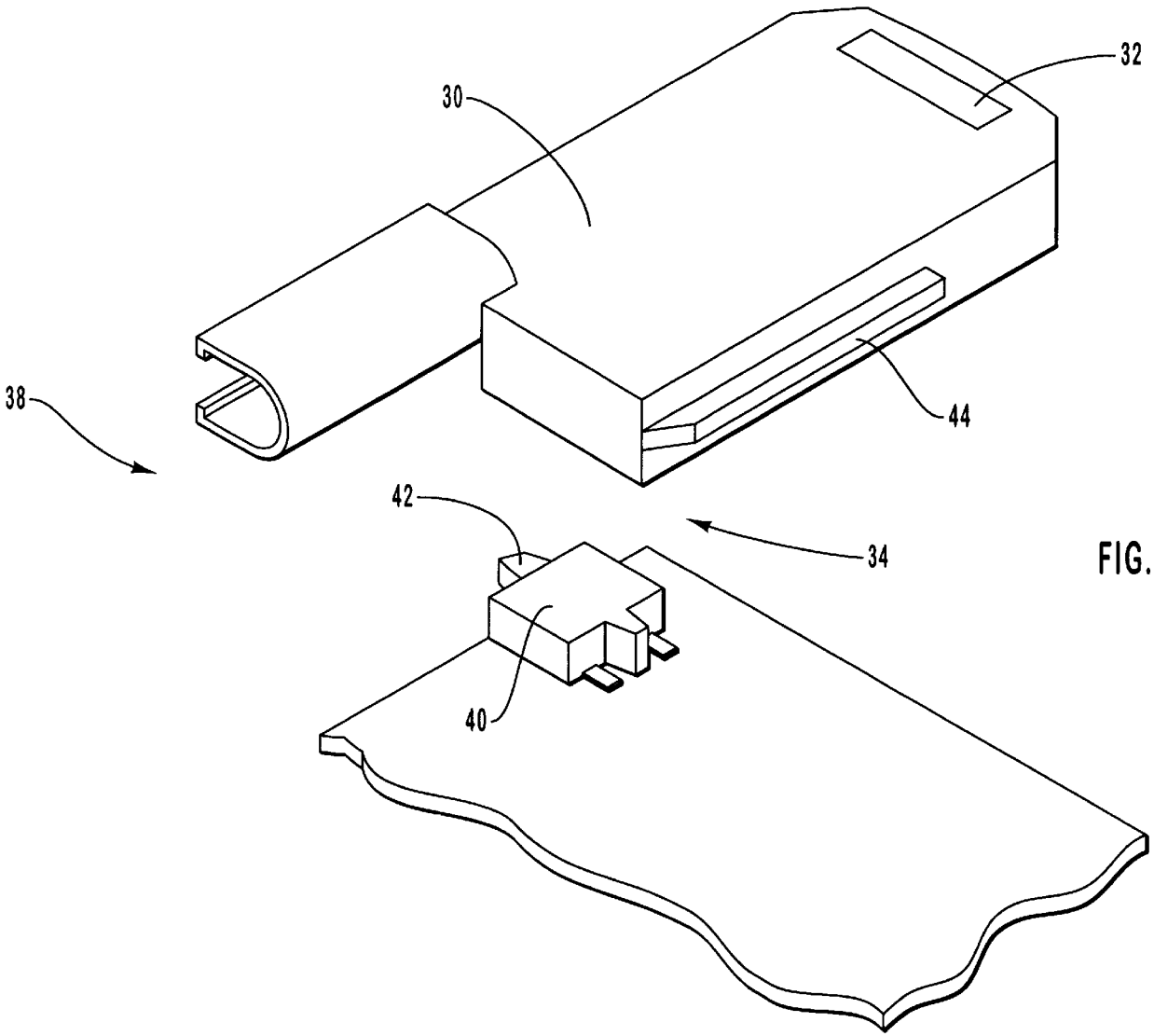
FIG. 2 is a perspective view of a preferred embodiment of the antenna system, with a control mechanism including a mechanical switch, illustrating the retractable platform in the extended position.
Figure 3:
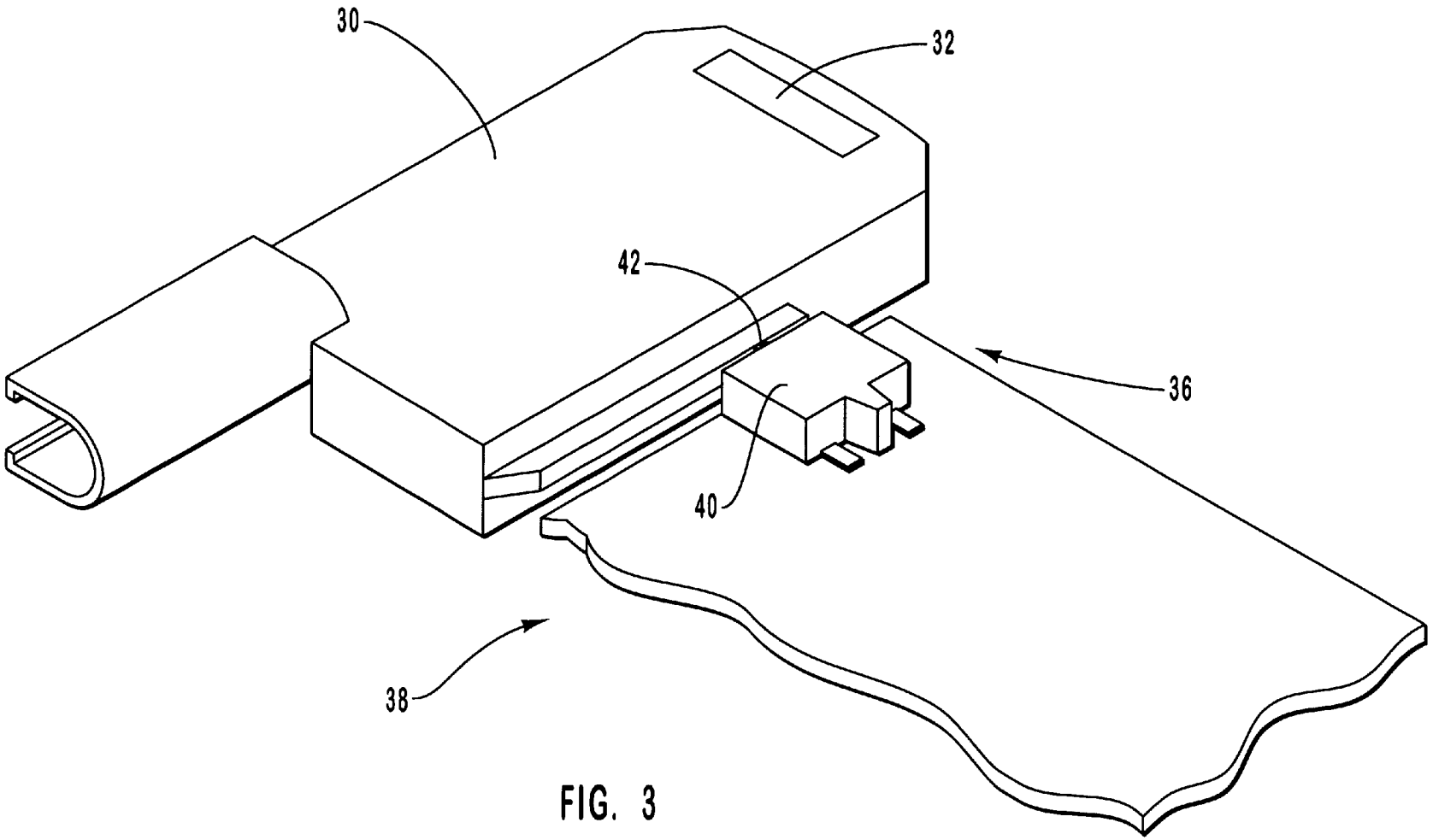
FIG. 3 is a perspective view of the antenna system shown in FIG. 2, illustrating the retractable platform in the retracted position.

As shown in FIGS. 2 and 3, the retractable platform 30 is selectively movable between an extended position 34 and a retracted position 36, respectively. In the extended position 34, the antenna 32 is at least substantially disposed external to the communication card 16 in order to minimize interference, obstruction, noise, etc. Preferably, in the extended position 34, the antenna 32 is located at such a distance that it minimizes interference with the communication card and the host device, such as the computer 10. In the retracted position, the retractable platform 30 and the antenna 32 are substantially disposed within the body of the communication card 16.

Wireless communication is only enabled or operable when the retractable platform 30 is disposed in the extended position 34, and wireless communication is not available or possible when the retractable platform 30 is in the retracted position 36. Thus, operation of the wireless communication is controlled by the positioning of the retractable platform 30. Preferably, only the wireless communication feature is inoperable or not enabled when the retractable platform 30 is in the retracted position, but the entire communication card 16 may be inoperable or not enabled. As discussed in more detail below, the operation of the wireless communication system is preferably automatically controlled according to the positioning of the retractable platform 30. Thus, the user does not have to take any additional steps or procedures to enable or disable wireless communication. Alternatively, the user may manually select whether wireless communication is enabled.

In greater detail, a control mechanism 38 is used to control when wireless communication is available or operable. The control mechanism 38 may use various methods to determine or sense the positioning of the retractable platform 30. For example, as best seen in FIGS. 2 and 3, the control mechanism 38 may comprise a mechanical switch 40 that is used to turn the wireless communication on or off. The mechanical switch 40 includes an engagement section 42 that is configured to contact or engage an outwardly projection portion 44 of the retractable platform 30. In this illustrative embodiment, the projecting portion 44 does not engage the engagement section 42 when the platform is in the extended position and wireless communication is permitted. On the other hand, in the retracted position 36, as shown in FIG. 3, the engagement section 42 contacts the projecting portion 44 and wireless communication is not permitted. One skilled in the art will appreciate that other types of switches, such as toggle, contact or leaf or spring switches, may be utilized, and the switches may have various configurations such as indicating when the retractable platform 30 is in the retracted position.

Figure 4:
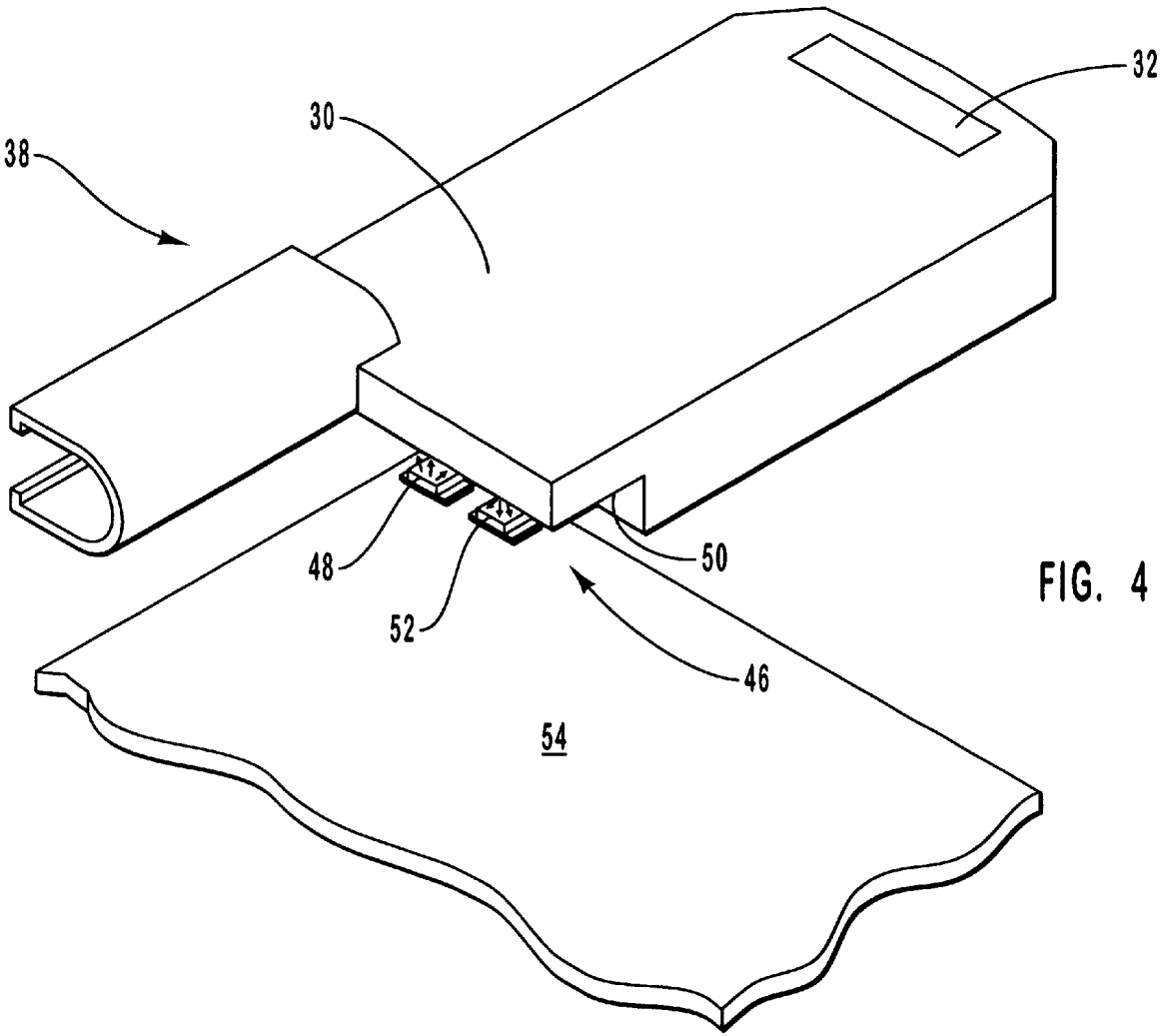
FIG. 4 is a perspective view of another preferred embodiment of the antenna system, with a control mechanism including an optical system, illustrating the retractable platform in the extended position.
Figure 5:
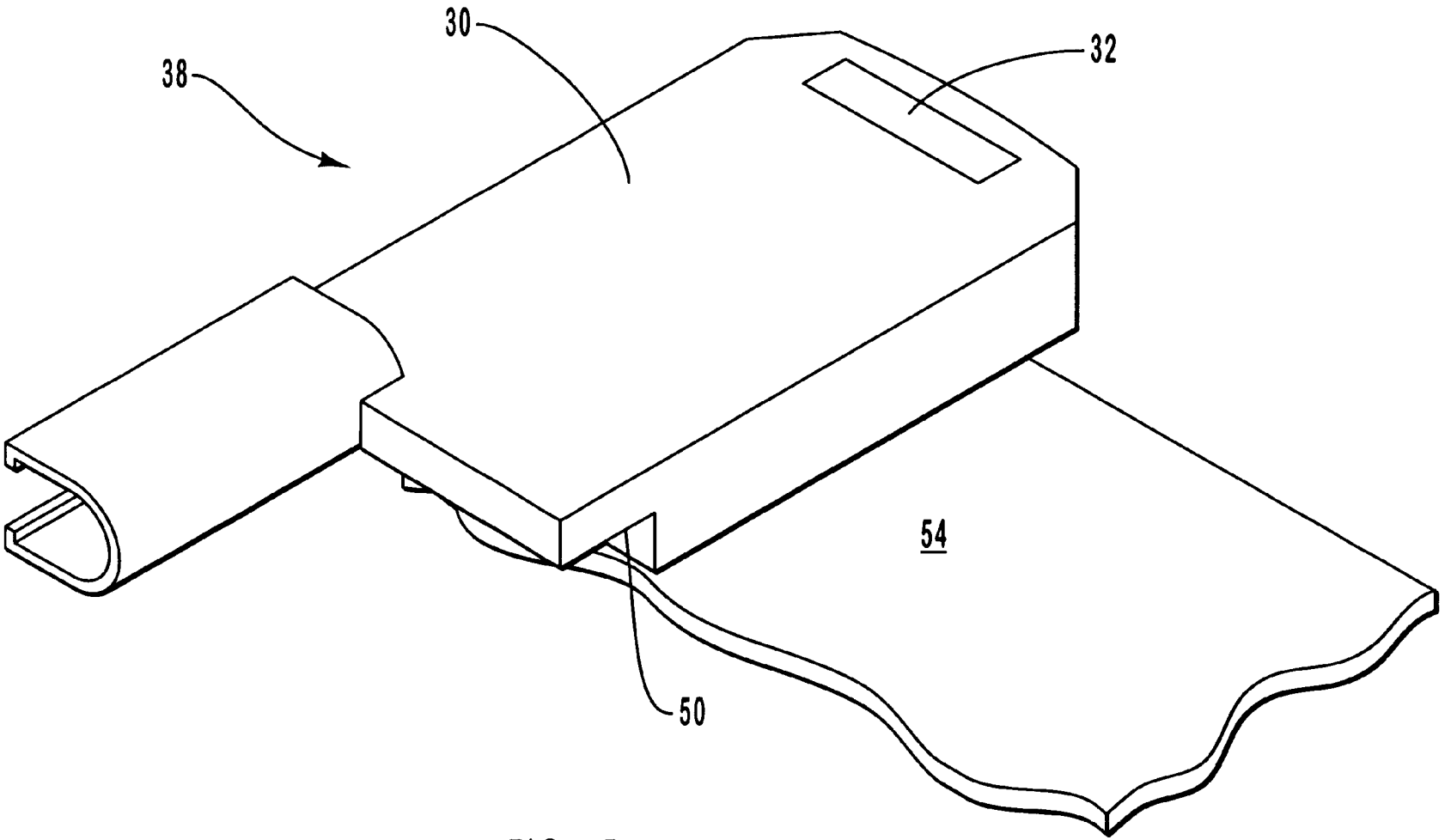
FIG. 5 is a perspective view of the antenna system shown in FIG. 4, illustrating the retractable platform in the retracted position.

As seen in FIGS. 4 and 5, the control mechanism 38 may use an optical or light-based system 46 to determine the positioning of the retractable platform 30, and that determines if wireless communication is operable or inoperable. The optical system 46 includes a light source 48, a reflective surface 50 and a detector 52. As shown in the accompanying figures, the light source 48 is connected to a portion of the communication card 16, such as a PCB 54, and it directs light towards the reflective surface 50 of the retractable platform 30. When the retractable platform 30 is in the extended position 34, the light is reflected by the reflective surface 50 and it is received by the detector 52. Thus, the optical system 46 determines the location of the retractable platform 30, and the operational state of wireless communication is based upon the positioning of the platform. For example, when the detector 52 does not detect light from the light source 48, that indicates that the tractable platform is in the retracted position and wireless communication should not be available. One skilled in the art will appreciate that the optical system 46 could include various components such as light emitting diodes (LEDs), light sensing diodes, light pipes, etc. to determine the positioning of the retractable platform 30.

Figure 6:
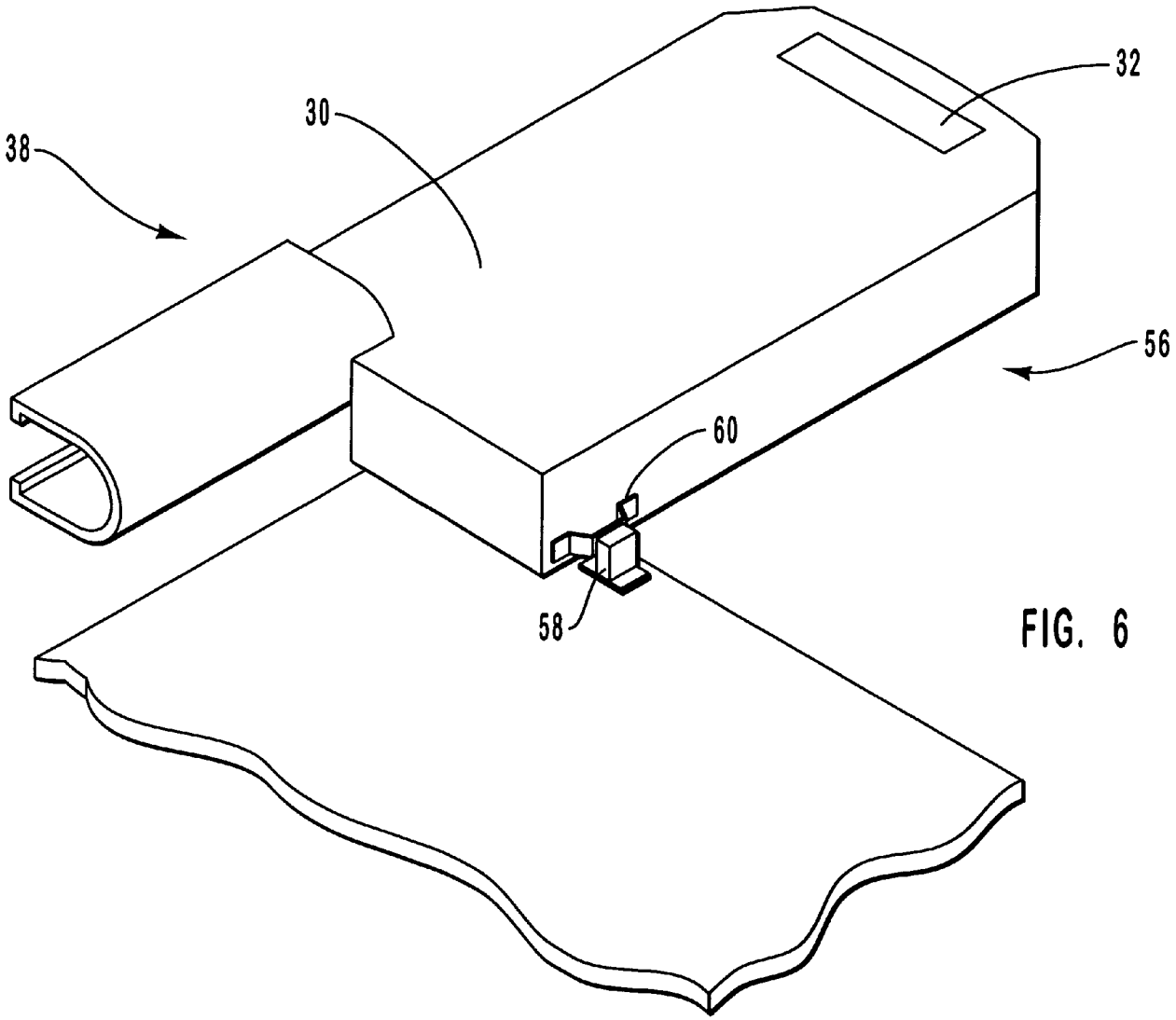
FIG. 6 is a perspective view of yet another preferred embodiment of the antenna system with a control mechanism including an electrical system, illustrating the retractable platform in the extended position.
Figure 7:
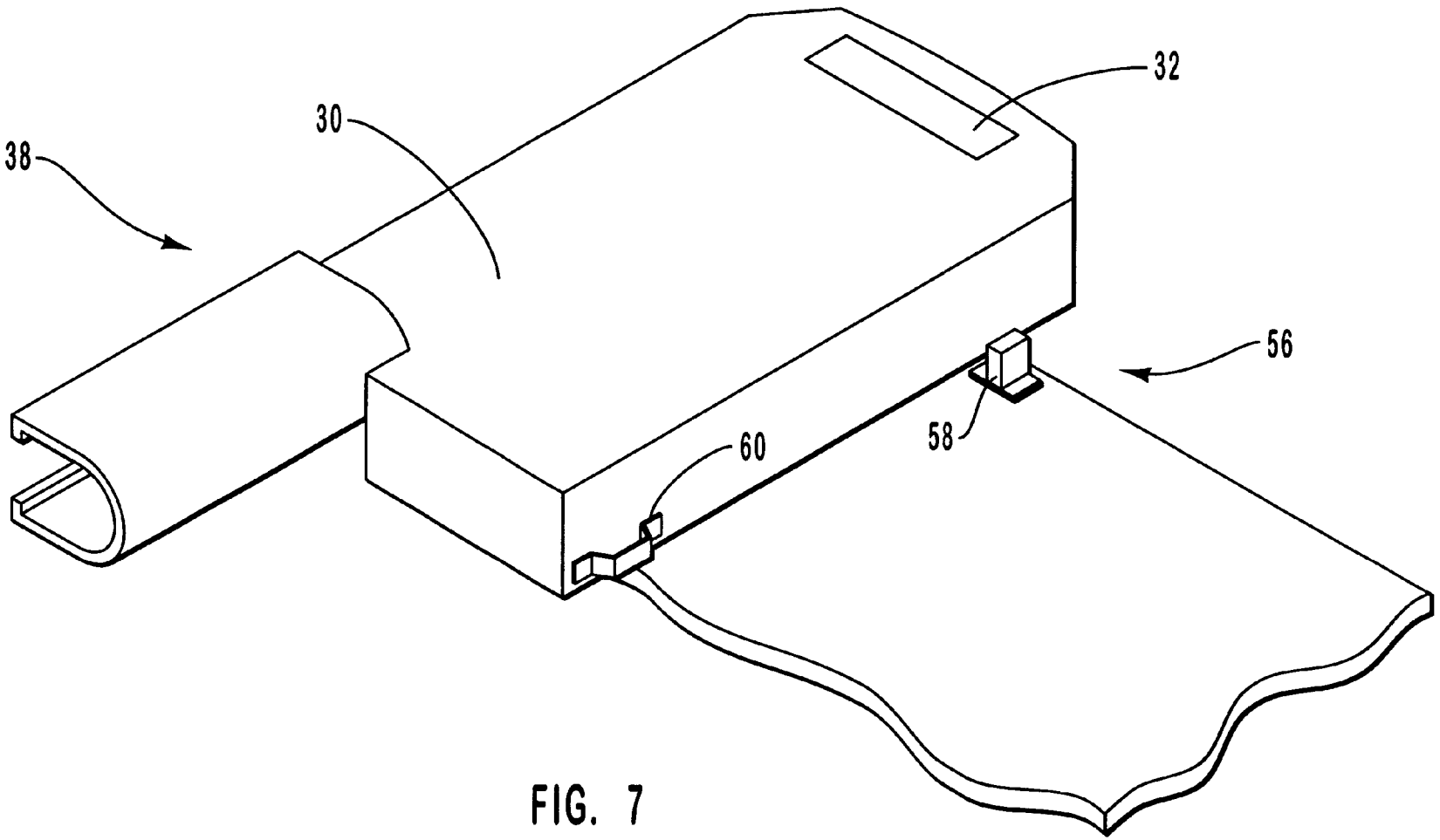
FIG. 7 is a perspective view of the antenna system shown in FIG. 6, illustrating the retractable platform in the retracted position.

As seen in FIGS. 6 and 7, the control mechanism 38 may also utilize an electrical system 56 to determine the positioning of the retractable platform 30. The electrical system 56 may include electrical contacts 58 attached to the communication card 16 that are capable of being in electrical communication with corresponding electrical pads 60 on the retractable platform 30. When the retractable platform 30 is in the extended position 34, the electrical contacts 58 are in electrical communication with the electrical pads 60. Thus, the electrical system 56 has determined that the retractable platform 30 is in the extended position 34 and wireless communication should be enabled. When the electrical contacts 58 and pads 60 are not in the electrical communication, that indicates that the retractable platform 30 is in the retracted position 36. It will be understood that a wide variety of electrical components and systems may be used to determine the positioning of the retractable platform 30.

Figure 9:
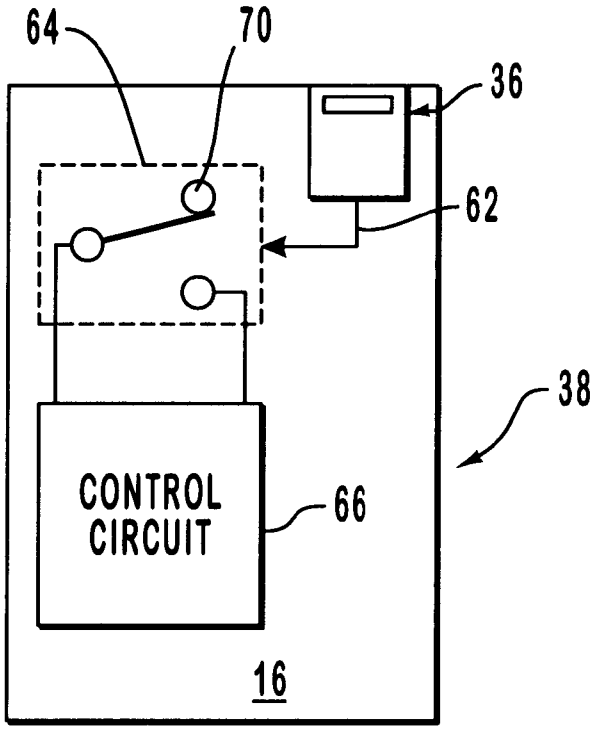
FIG. 9 is a block diagram showing another preferred embodiment of the antenna system, illustrating the retractable platform in a retracted position.
Figure 8:
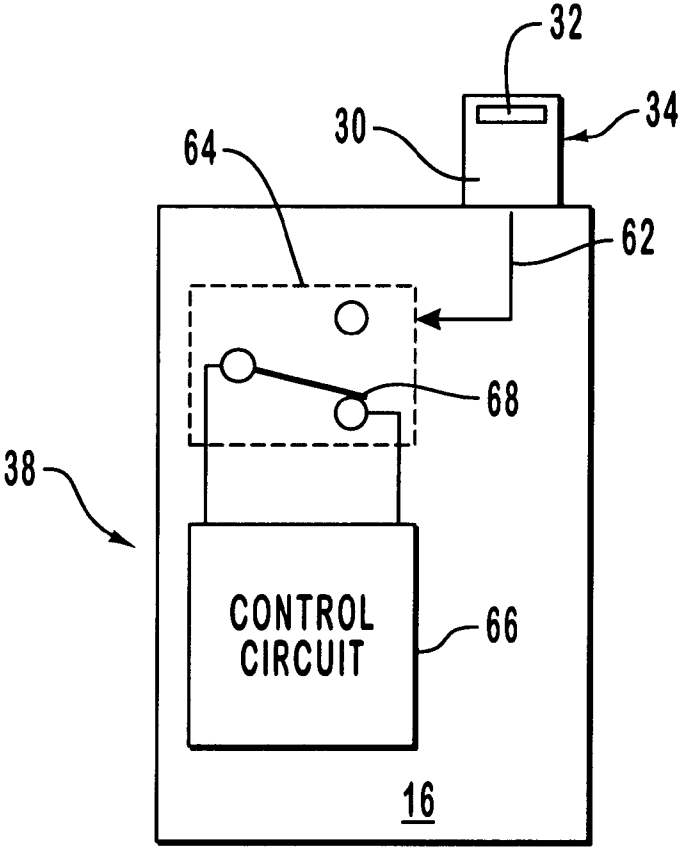
FIG. 8 is a block diagram of a preferred embodiment of the antenna system, illustrating the retractable platform in an extended position.

As seen in FIGS. 8 and 9, the control mechanism 38 is preferably attached to the communication card 16 and the movement of the retractable platform 30 is transmitted to the control mechanism over the line 62. In greater detail, the physical movement of the retractable platform 30 operates a switch mechanism 64 that is connected to a control circuit 66. When the retractable platform 30 is physically moved to the extended position 34, the control mechanism 38 causes the switch mechanism 64, as shown in FIG. 8, to move to a predetermined position 68 that indicates an "in use" status signal to be supplied to a control circuit 66. Thus, in the extended position 34, the switch mechanism 64 indicates that the antenna system 12 should be capable of transmitting and receiving wireless signals, and the control circuit 66 causes electrical power to be supplied to the antenna system 12. While this could be implemented in a number of different ways, in one implementation the control circuit 66 may be an extension of the power pin on the edge connector of communication card 16 that is used to receive electrical power from the host computer, which is merely placed in a closed position to permit the flow of electrical current (or similar power supply arrangement) to the antenna system 12. It will be appreciated that while the illustrated control circuit is used to control the supply of electrical power, it could be implemented to control other types of operational parameters as well.

FIG. 9 illustrates the retractable platform 30 in the retracted position 36. This position causes the switch mechanism 64 to assume a "not in use" status signal, which causes the control circuit 66 to disengage electrical power from being received by the antenna system 12. Alternatively, instead of completely turning off power to the antenna system 12, an arrangement may be utilized whereby only a limited amount of power is supplied to the antennal system, but power to the entire communication card could be left on or turned off.

The implementation and actuation of switch mechanism 64 can also include various other mechanical, optical, magnetic, proximity or other switching technologies that are well known in the art, some of which are described below. Also, while the illustrated embodiment in those figures contemplates actuation of the switch mechanism 64 via the physical retraction and extension of the retractable platform 30, actuation could also be manually invoked by the user.

Figure 10:
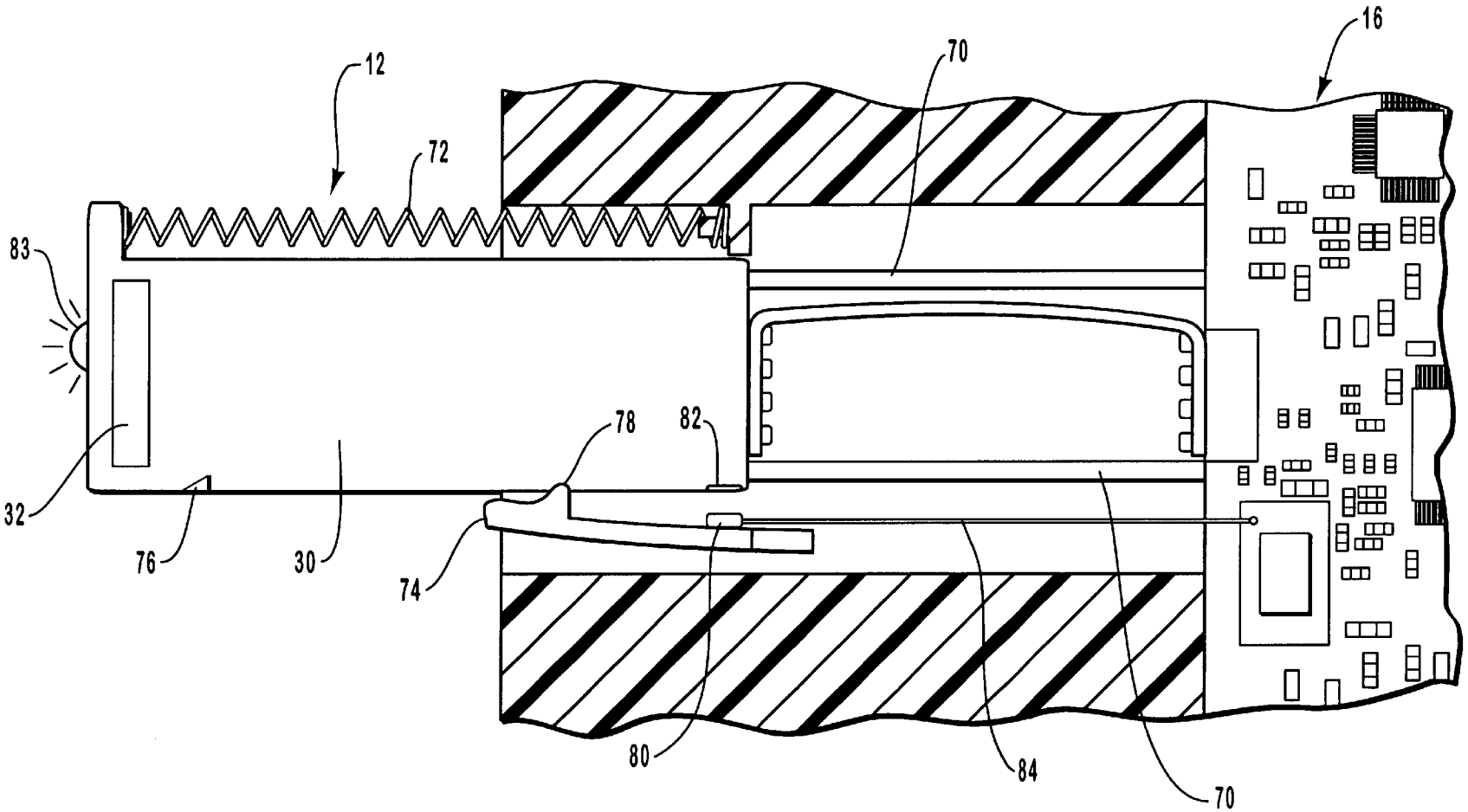
FIG. 10 is a cross-sectional top view of a preferred embodiment of the retractable platform, illustrating a preferred switching arrangement.

FIGS. 10 through 13, which illustrate various embodiments for implementing the switch mechanism 64 described above. FIG. 10 is a cross-sectional view of a preferred embodiment of the retractable platform 30 and antenna 32. The retractable platform 30, which is shown in the extended position 34, is mounted on slide rails 70 so that the platform can be retracted within the housing of the card 16. A spring 72 or a similar biasing means can be used to aid in the extension of the platform 30. A latch mechanism 74, or similar type of retention mechanism, can be used in conjunction with receiving tabs 76 and 78 to assist in maintaining the position of the platform 30 in either an extended or a retracted position.

As shown in FIG. 10, it is further shown how the physical manipulation of the retractable platform 30 is used to actuate the positioning of a switch mechanism 64 to control the operational state of wireless communication. For instance, in this embodiment the switch mechanism 64 is an optical switch arrangement that includes a photo detector emitter device 80 and a corresponding reflective surface 82 that is formed on an outer surface of the retractable platform 30. In operation, when the retractable platform 30 is moved to the extended position 34 the photo detector emitter 80 will detect the corresponding position of the reflective surface 82. The photo detector emitter 80 will then generate an "in use" status signal via schematic line 84. This signal is in turn supplied to a corresponding control circuit, such as a power control circuit as discussed above. In this position, the power control circuit will permit electrical power to flow to the antenna system 12.

An indicator, such as a light source 83, may be disposed on the retractable platform 30 and lit when the platform is in the extended position 34 to indicate that the antenna system 12 is operational. When the retractable platform 30 is moved to the retracted position 36, the light 83 will turn off to indicate that the antenna system 12 is no longer operational. In addition to indicating the operational status of the antenna system 12, the indicator could alternatively be used to indicate other information such as power, status, diagnostics, etc. Though described here as a light source, the indicator could comprise any one of a variety of signals. Also, the indicator could alternatively be disposed on the communication card 16, or even the antenna 32 itself.

Figure 11:
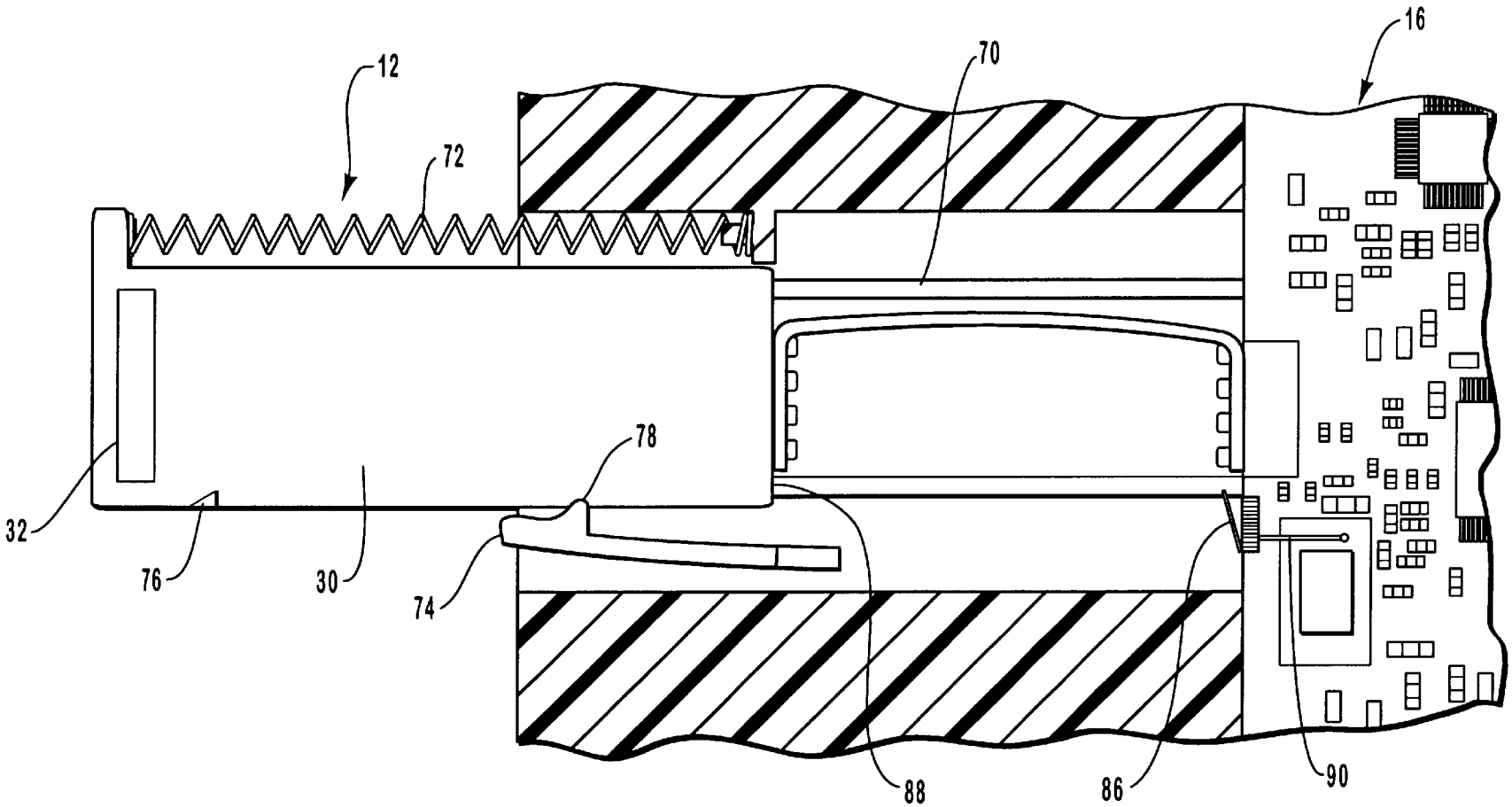
FIG. 11 is a cross-sectional top view of another preferred embodiment of the retractable platform, illustrating another preferred switching arrangement.

As seen in FIG. 11, which illustrates another presently preferred embodiment for the switch mechanism 64 that is actuated via movement of the retractable platform 30. As shown in the accompanying drawing, a mechanical switch arm 86 is positioned to engage a lower surface 88 of the retractable platform 30 when it is in the retracted position 36. In particular, the mechanical switch arm 86 is positioned such that when the platform 30 is retracted, the surface 88 will abut against a portion of the switch arm 86 so as to depress the switch and thereby actuate it into a closed position. In operation, when the switch arm 86 is in the open position, as illustrated, a corresponding "in use" signal will be generated and supplied via schematic line 90 to an appropriate control circuit. Alternatively, in the retracted position 36, the retractable platform 30 will cause the switch arm 86 to be moved to a closed position and thereby generate a "not in use" status signal. In this case, wireless communication will not be permitted.

Figure 12:
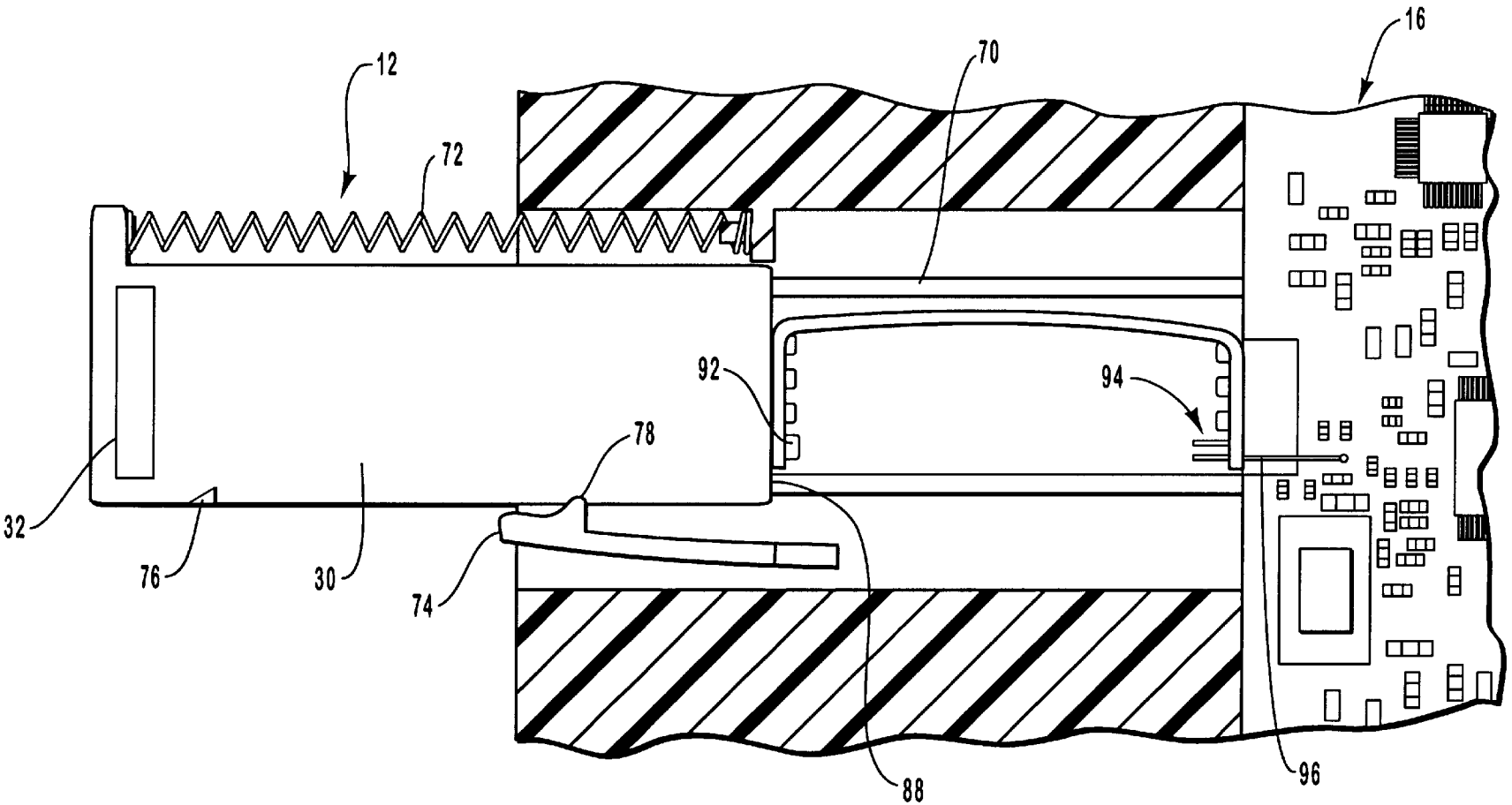
FIG. 12 is a cross-sectional top view of still another preferred embodiment of the retractable platform, illustrating yet another alternative preferred switching arrangement.

FIG. 12 illustrates still another preferred embodiment with a conductive shorting bar 92 positioned at the lower end of the retractable platform 30. A pair of electrical contacts 94 is in an open position when the retractable platform 30 is in the extended position 34, as shown in the accompanying figure. This state corresponds with a "in use" status, which signal is indicated by way of schematic line 96 and supplied to the appropriate control circuit. When the retractable platform 30 is retracted, the shorting bar 92 will cause an electrical short to occur between the contacts 94. In this case, an appropriate electrical signal will be supplied on schematic line 96 indicating the "not in use status," and the control circuit can take appropriate action.

Figure 13:
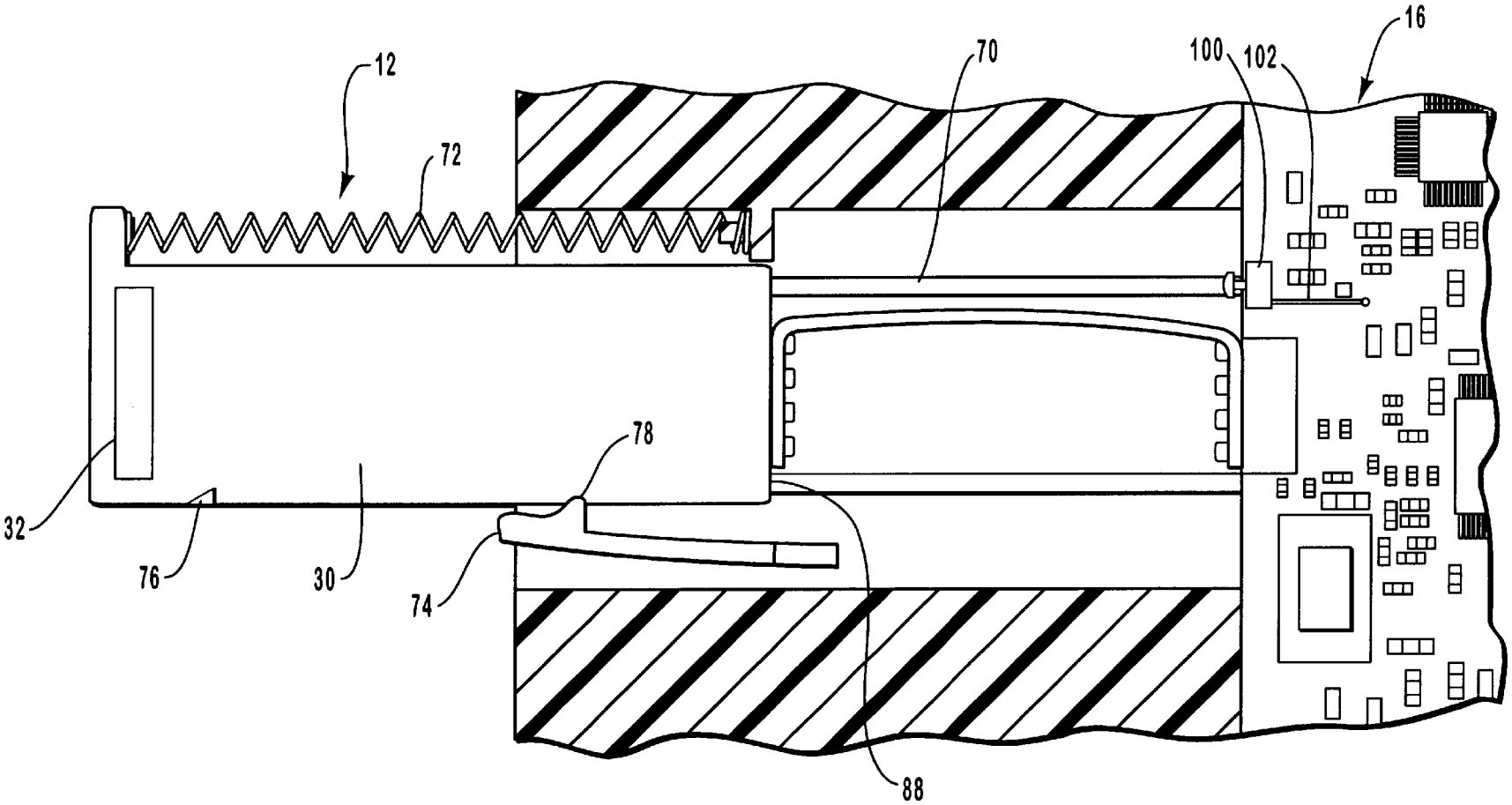
FIG. 13 is a cross-sectional top view of a further preferred embodiment of the retractable platform, illustrating another preferred switching arrangement.

FIG. 13 illustrates still another embodiment of the present invention. As is shown here, a push-button type of mechanical switch 100 is positioned so that when the retractable platform 30 is retracted within the recess, it actuates the push-button switch. The actuated switch corresponds to a "not in use" status, which is supplied to the control circuit. Appropriate action can then be taken including limiting or eliminating the supply of electrical power to the antenna system 12. In contrast, when the retractable platform 30 is extended out from the card 16 and is thereby "in use," the push-button switch 100 will not be actuated and a corresponding signal will be supplied on the schematic line 102. In this case, electrical power would be supplied to the PC card.

It will be appreciated that while a number of different switching type of arrangements have been described, that any one of a number of different types of mechanisms could also be used.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An electrical apparatus that is capable of wireless communication, the electrical apparatus comprising:

a communication card including a housing with a first end and a second end, the housing at least partially enclosing a printed circuit board;

a retractable platform connected to the communication card, the retractable platform being selectably movable between a first position and a second position;

an antenna capable of wireless communication connected to the retractable platform, at least a substantial portion of the antenna being disposed outside of the housing of the communication card in the first position and at least a substantial portion of the antenna being disposed inside of the housing of the communication card in the second position;

a control mechanism connected to the retractable platform, the control mechanism automatically controlling the operational status of wireless communication based upon the positioning of the retractable platform; and an indicator connected to the retractable platform, the indicator indicating the operational status of wireless communication.

2. An electrical apparatus that is capable of wireless communication, the electrical apparatus comprising:

a communication card including a housing with a first end and a second end, the housing at least partially enclosing a printed circuit board;

a retractable platform connected to the communication card, the retractable platform being selectably movable between a first position and a second position;

an antenna capable of wireless communication connected to the retractable platform, at least a substantial portion of the antenna being disposed outside of the housing of the communication card in the first position and at least a substantial portion of the antenna being disposed inside of the housing of the communication card in the second position;

a control mechanism connected to the retractable platform, the control mechanism automatically controlling the operational status of wireless communication based upon the positioning of the retractable platform; and an indicator connected to the communication card, the indicator indicating the operational status of wireless communication.

3. An electrical apparatus that is capable of wireless communication, the electrical apparatus comprising:

a communication card including a housing with a first end and a second end, the housing at least partially enclosing a printed circuit board;

a retractable platform connected to the communication card, the retractable platform being selectably movable between a first position and a second position;

an antenna capable of wireless communication connected to the retractable platform, at least a substantial portion of the antenna being disposed outside of the housing of the communication card in the first position and at least a substantial portion of the antenna being disposed inside of the housing of the communication card in the second position;

a control mechanism connected to the retractable platform, the control mechanism automatically controlling the operational status of wireless communication based upon the positioning of the retractable platform; and an indicator connected to the antenna, the indicator indicating the operational status of wireless communication.

4. An electrical apparatus that is capable of wireless communication, the electrical apparatus comprising:

a communication card including a housing with a first end and a second end, the housing at least partially enclosing a printed circuit board;

a retractable platform connected to the communication card, the retractable platform being selectably movable between a first position and a second position;

an antenna capable of wireless communication connected to the retractable platform, at least a substantial portion of the antenna being disposed outside of the housing of the communication card in the first position and at least a substantial portion of the antenna being disposed inside of the housing of the communication card in the second position; and a control mechanism connected to the retractable platform, the control mechanism automatically controlling the operational status of wireless communication based upon the positioning of the retractable platform;

wherein the control mechanism includes an optical switch to determine the positioning of the retractable platform.

5. The electrical apparatus as in claim 4, further comprising a light source attached to the communication card, a reflective surface positioned on the retractable platform, and a detector attached to the communication card, the light source, the reflective surface and detector being positioned so that the detector will detect positioning of the retractable platform in the first position and the second position.

6. An electrical apparatus that is capable of wireless communication, the electrical apparatus comprising:

a communication card including a housing with a first end and a second end, the housing at least partially enclosing a printed circuit board;

a retractable platform connected to the communication card, the retractable platform being selectably movable between a first position and a second position;

an antenna capable of wireless communication connected to the retractable platform, at least a substantial portion of the antenna being disposed outside of the housing of the communication card in the first position and at least a substantial portion of the antenna being disposed inside of the housing of the communication card in the second position; and a control mechanism connected to the retractable platform, the control mechanism automatically controlling the operational status of wireless communication based upon the positioning of the retractable platform;

wherein the control mechanism includes a mechanical switch to determine the positioning of the retractable platform.

7. The electrical apparatus as in claim 6, further comprising an extension on the retractable platform, the mechanical switch being attached to the communication card, wherein the extension engages the mechanical switch in the first position, and wherein the extension does not engage the switch in the second position.

8. An electrical apparatus that is capable of wireless communication, the electrical apparatus comprising:

a communication card including a housing with a first end and a second end, the housing at least partially enclosing a printed circuit board;

a retractable platform connected to the communication card, the retractable platform being selectably movable between a first position and a second position;

an antenna capable of wireless communication connected to the retractable platform, at least a substantial portion of the antenna being disposed outside of the housing of the communication card in the first position and at least a substantial portion of the antenna being disposed inside of the housing of the communication card in the second position; and a control mechanism connected to the retractable platform, the control mechanism automatically controlling the operational status of wireless communication based upon the positioning of the retractable platform;

wherein the control mechanism includes an electrical switch to determine the positioning of the retractable platform.

9. The electrical apparatus as in claim 8, further comprising a first electrical contact attached to the communication card and a second electrical contact attached to the retractable platform, the first and second electrical contacts being in electrical communication in the first position to indicate the positioning of the retractable platform.

10. An electrical apparatus capable of wireless communication, the electrical apparatus comprising:

a communication card;

a retractable platform connected to the communication card, the retractable platform movable between a first position and a second position;

an antenna connected to the retractable platform, the antenna being substantially disposed outside of the communication card when the retractable platform is in the first position, the antenna being substantially disposed within the communication card when the retractable platform is in the second position, the antenna being capable of wireless communication in the first position, the antenna being incapable of wireless communication in the second position; and an indicator connected to the retractable platform, the indicator indicating the operational status of wireless communication.

11. An electrical apparatus capable of wireless communication, the electrical apparatus comprising:

a communication card;

a retractable platform connected to the communication card, the retractable platform movable between a first position and a second position;

an antenna connected to the retractable platform, the antenna being substantially disposed outside of the communication card when the retractable platform is in the first position, the antenna being substantially disposed within the communication card when the retractable platform is in the second position, the antenna being capable of wireless communication in the first position, the antenna being incapable of wireless communication in the second position; and an extension on the retractable platform, and a switch to determine the position of the retractable platform, the switch being attached to the communication card, the extension engaging the switch when the retractable platform is in the first position and the extension not engaging the switch when the retractable platform is in the second position.

12. A method of selectively operating an electronic apparatus that is capable of wireless communication, the electronic apparatus including a communication card having a retractable platform, the retractable platform having connected it to an antenna capable of wireless communication, the method comprising the steps of:

selectively moving the retractable platform from a retracted position wherein the antenna is disposed substantially within the communication card to an extended position wherein the antenna is disposed substantially outside the communication card;

causing a control mechanism to automatically enable the antenna to engage in wireless communication as a result of the selective movement of the retractable platform from the retracted position to the extended position; and determining the position of the retractable platform by causing a switch to be affected by the selective movement of the retractable platform.

* * * * *